US006160519A

United States Patent [19]

Hemmi

[11] Patent Number: 6,160,519

[45] Date of Patent: Dec. 12, 2000

[54] TWO-DIMENSIONALLY STEERED ANTENNA SYSTEM

[75] Inventor: Christian O. Hemmi, Plano, Tex.

[73] Assignee: Raytheon Company, Lexington, Mass.

[21] Appl. No.: 09/138,238

[22] Filed: Aug. 21, 1998

[51] Int. Cl.[7] ..... H01Q 19/06

[52] U.S. Cl. ..... 343/754; 343/753; 343/911 R; 343/911 L

[58] Field of Search ..... 343/753, 754, 343/911 R, 911 L, 853, 909; H01Q 19/06

[56] References Cited

U.S. PATENT DOCUMENTS

| | | | |
|---|---|---|---|
| 3,761,936 | 9/1973 | Archer et al. | 343/754 |
| 3,993,999 | 11/1976 | Hemmi et al. | 343/854 |
| 4,100,548 | 7/1978 | Hemmi et al. | 343/837 |
| 4,381,509 | 4/1983 | Rotman et al. | 343/754 |
| 4,769,646 | 9/1988 | Raber et al. | 343/753 |
| 5,327,147 | 7/1994 | Caille et al. | 343/700 MS |
| 5,548,294 | 8/1996 | Sturza | 342/372 |
| 5,576,721 | 11/1996 | Hwang et al. | 343/753 |
| 5,621,415 | 4/1997 | Tuck | 342/354 |
| 5,642,122 | 6/1997 | Lockie et al. | 343/881 |
| 5,650,788 | 7/1997 | Jha | 343/700 MS |
| 5,677,796 | 10/1997 | Zimmerman et al. | 359/654 |
| 5,736,959 | 4/1998 | Patterson et al. | 342/354 |
| 5,936,588 | 8/1999 | Rao et al. | 343/754 |

FOREIGN PATENT DOCUMENTS

| | | |
|---|---|---|
| 0 373 257 A1 | 12/1988 | European Pat. Off. . |
| 0 707 356 A1 | 4/1994 | European Pat. Off. . |
| 0 793 291 A2 | 2/1997 | European Pat. Off. . |
| 0 803 930 A2 | 10/1997 | European Pat. Off. . |
| 2045714 | 5/1971 | France . |
| 2 205 996 | 12/1988 | United Kingdom . |
| 2 315 644 | 2/1998 | United Kingdom . |
| WO 98/10305 | 3/1998 | WIPO . |

OTHER PUBLICATIONS

J. Paul Shelton, "Focusing Characteristics of Symmetrically Configured Bootlace Lenses," IEEE Transactions on Antennas and Propagation, vol. AP–26, No. 4, pp. 513–518, Jul. 1978.

David T. Thomas, "Multiple Beam Synthesis of Low Sidelobe Patterns in Lens Fed Arrays," IEEE Transactions on Antennas and Propagation, vol. AP–26, No. 6, pp. 883–886, Nov. 1978.

R. Gupta, A. Zaghloul, T. Hampsch, and F. Assal, "Development of a Beam–Forming Matrix Using MMICs for Multibeam Active Phased Arrays," IEEE 1994 APS International Symposium, vol. 2, pp. 844–847.

E.P. Ekelman, E.C. Kohls, A.I. Zaghloul, and F.T. Assal, "Measured Performance of a Ku–Band Multibeam High–Power Phased–Array," IEEE APS International Symposium, pp. 852–855, Jun. 1994.

A.G. Roederer, N.E. Jensen, and G.A.E. Crone, "Some European Satellite–Antenna Developments and Trends," IEEE Antennas and Propagation Magazine, vol. 38, No. 2, pp. 9–19, Apr. 1996.

Richard C. Johnson, "Antenna Engineering Handbook," Third Ed., pp. 18–2 to 18–7.

PCT International Search Report, Sep. 22, 1999.

*Primary Examiner*—Don Wong
*Assistant Examiner*—Shih-Chao Chen
*Attorney, Agent, or Firm*—Baker Botts L.L.P.

[57] ABSTRACT

A two-dimensionally steered antenna system (40) includes a planar lensing system (64, 94) operable to focus signals received from a plurality of ground-based cells (20). A first steering system (66) is operable to steer a beam (32) for each ground-based cell (20) in a first direction by weighing signals associated with the ground-based cell (20) based on a position of the antenna system (40) relative to the ground-based cell (20) in the first direction. A second steering system (96) is operable to steer the beam (32) for each ground-based cell (20) in a second direction by weighing signals associated with the ground-based cell (20) based on a position of the antenna system (40) relative to the ground-based cell (20) in the second direction.

42 Claims, 4 Drawing Sheets

TWO-DIMENSIONALLY STEERED ANTENNA SYSTEM

RELATED APPLICATIONS

This application is related to copending U.S. patent application Ser. No. 09/138,821 filed Aug. 21, 1998, entitled "LENS SYSTEM FOR ANTENNA SYSTEM" and to copending U.S. patent application Ser. No. 09/452,019, entitled "MULTI-LEVEL SYSTEM AND METHOD FOR STEERING AN ANTENNA"

TECHNICAL FIELD OF THE INVENTION

This invention relates generally to satellite antenna systems and more particularly to an improved two-dimensionally steered antenna system.

BACKGROUND OF THE INVENTION

Communications networks employ satellites operating in geosynchronous orbits in combination with terrestrial facilities such as land lines, microwave repeaters, and undersea cables to provide communications over vast areas of the earth. Geosynchronous satellites and terrestrial facilities are both expensive to install and to maintain and thus are not a cost effective means of increasing network capacity. In addition, geosynchronous satellites which operate at an altitude of 22,300 miles above the earth are unsuitable for supporting cellular service because of the extremely high power levels that would be required to communicate with satellites at that altitude.

More recently, constellations of low earth orbit (LEO) satellites have been proposed and are being developed as a cost effective means for providing increased capacity and supporting cellular and broadband data service for communications networks. In such a constellation, the satellites are divided into a number of orbital planes. Because low earth orbit satellites move rapidly with respect to the earth, each orbital plane includes a number of satellites that maintain continuous coverage for underlying cells defined on the surface of the earth. The cells represent coverage regions for the satellites.

Low earth orbit satellites utilize antennas which form a cluster of beams matching the ground-based cells. In each satellite, the beams must be steered to maintain alignment with the cells during the time the satellite moves one cell width along its orbit. After the satellite has moved one cell width, all the beams are ratcheted forward one cell width in the direction of flight and the beams are reassigned to the next set of cells in the flight direction.

Existing beam steering systems are inadequate due to their size, complexity, and cost. Mechanical steering apparatuses, for example, are too bulky and heavy for use in satellites. Electronic steering systems typically use multiple phase shifters per antenna array element or a hybrid divider network with distributed phase shifters as a variable power divider network. The use of phase shifters greatly increases complexity of the antenna system and thus cost.

SUMMARY OF THE INVENTION

In accordance with the present invention, an improved two-dimensionally steered antenna system and method are provided that substantially eliminate or reduce disadvantages and problems associated with previously developed systems and methods. In particular, the present invention provides a two-dimensionally steered antenna system that uses a compact planar lensing system.

In one embodiment of the present invention, a two-dimensionally steered antenna system includes a planar lensing system operable to focus signals received from a plurality of ground-based cells. A first steering system is operable to steer a beam for each ground-based cell in a first direction by weighing signals associated with the ground-based cell based on a position of the antenna system relative to the ground-based cell in the first direction. A second steering system is operable to steer the beam for each ground-based cell in a second direction by weighing signals associated with the ground-based cell based on a position of the antenna system relative to the ground-based cell in the second direction.

More specifically, in accordance with a particular embodiment of the present invention, the first and second steering systems each weigh signals associated with a ground-based cell by modulating the amplitude of the associated signals based on the position of the antenna system relative to the ground-based cell and combining modulated signals. In this embodiment, the first and second steering systems may each include a plurality of splitters operable to split an input signal into a plurality of intermediate paths. An amplitude modulator is coupled to each intermediate path to control the amplitude for the input signal on the intermediate path. A plurality of combiners are each operable to combine modulated signals from a plurality of intermediate paths originating from different splitters into a steered signal.

Technical advantages of the present invention include providing an improved two-dimensionally steered antenna system. In particular, the antenna system uses a planar lens array to focus signals. The planar lenses allow lensing and amplitude modulation functions to be combined into planar slats. As a result, the beam forming and steering network can be located internally to a satellite or other platform, with only radiating elements protruding from the base. The planar slats are compact, light weight, and can be efficiently packed together. Accordingly, they are ideal for satellite and other applications that are size and weight sensitive. In addition, the planar lens and amplitude modulation slats can be formed from only two circuit layers and are therefore relatively inexpensive to fabricate.

Other technical advantages will be readily apparent to one skilled in the art from the following figures, descriptions, and claims.

BRIEF DESCRIPTION OF THE DRAWINGS

For a more complete understanding of the present invention and its advantages, reference is now made to the following description taken in conjunction with the accompanying drawings, in which.

DETAILED DESCRIPTION OF THE INVENTION

Figure 1:
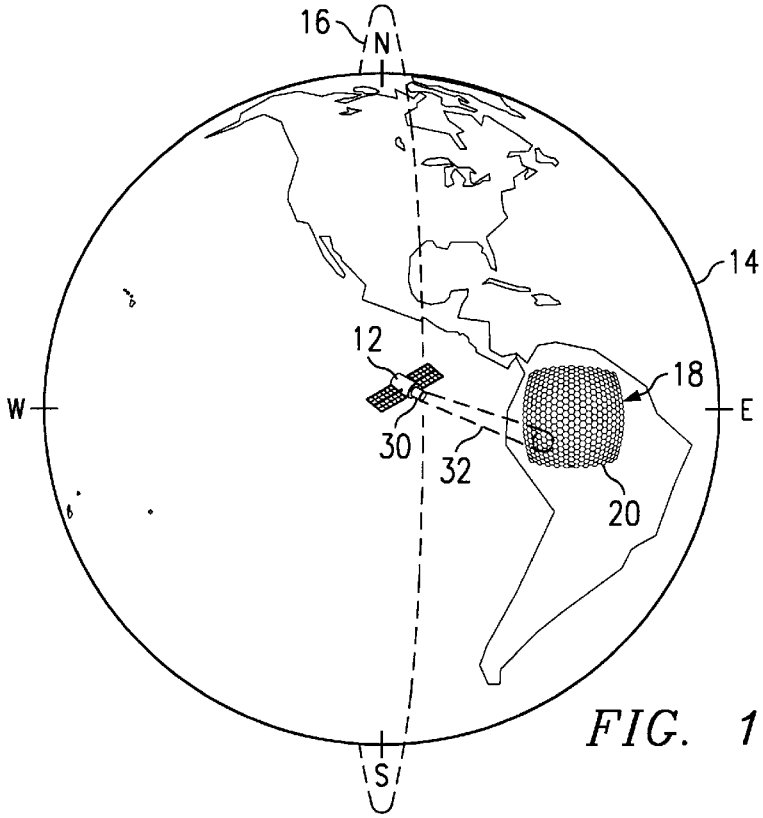
FIG. 1 is a schematic diagram illustrating a satellite in low earth orbit (LEO) in accordance with one embodiment of the present invention.

FIG. 1 illustrates a satellite 12 orbiting the earth 14 in a low earth orbit 16 and projecting a satellite footprint 18 onto a fixed grid of ground-based cells 20. The low earth orbit (LEO) satellite 12 forms part of a constellation of similar satellites that provide continuous coverage for the ground-based cells 20. In the constellation, the satellites are spaced apart in a plurality of orbital planes, with each orbital plane having a necessary number of satellites to provide continual coverage for the cells underlying that orbital plane. Thus, each satellite 12 immediately follows another satellite in its orbital plane and is itself immediately followed by still another satellite in that orbital plane. In one embodiment, for example, the constellation includes twenty-four (24) orbital planes with twelve (12) satellites in each orbital plane. In this exemplary embodiment, each satellite has an altitude of 1,350 kilometers, a footprint, or coverage area, 18, that is 1,660 kilometers by 1,660 kilometers, and an orbital period of about 112 minutes. It will be understood that the type, number, and orbital planes for the satellites 12 may be suitably varied.

Figure 2:
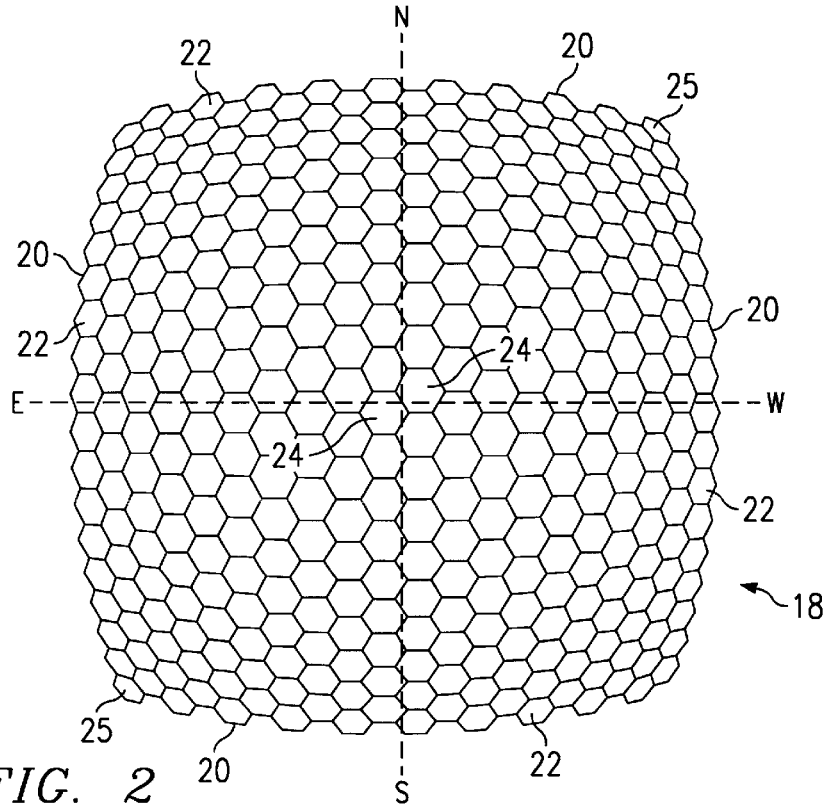
FIG. 2 is a schematic diagram illustrating ground-based cells within the coverage area for the satellite of FIG. 1.

FIG. 2 illustrates details of the ground-based cells within the footprint 18. For the exemplary embodiment in which the footprint 18 is 1,660 kilometers by 1,660 kilometers in size, the footprint 18 includes 725 hexagonal-shaped cells 20. Each hexagonal cell is 78.7 kilometers across. The size and shape of the ground-based cells 20 may be suitably varied so long as the cells 20 fully cover the footprint 18. For example, the footprint 18 may be tiled with square or radial cells 20.

Due to the geometry of low earth satellites 12 above the spherical surface of the earth 14, cells 22 near the edges of the footprint 18 have a much smaller angular size and closer angular spacing than cells 24 near the center of the footprint 18. In the exemplary embodiment, for example, the cells 24 at the center of the footprint 18 have an angular size of 3.5 degrees while the cells 22 near the edges of the footprint 18 have an angular size of 2.4 degrees and the cells 25 at the corner of the footprint 18 have an angular size of 1.8 degrees.

Returning to FIG. 1, the satellite 12 includes a multi-beam antenna system 30 for communicating directly with a plurality of portable, mobile, and fixed terminals in the ground-based cells 20. Each beam 32 is assigned to a ground-based cell 20. As described in more detail below, the multi-beam antenna system 30 shapes and steers each beam 32 so that the assigned ground-based cell 20 is illuminated by that beam 32 until the next beam 32 moves into position on that cell 20 or the next satellite 12 moves into position to illuminate the cell 20. Thus, the beams 32 are shaped to match the ground-based cells 20 and are steered to maintain alignment with the ground-based cells 20 during the time the satellite 12 moves one cell width along its orbit. After the satellite 12 has moved one cell width, the beams 32 are each ratcheted forward one cell width in the direction of flight and beams 32 are reassigned to the next set of cells in the flight direction. The set of cells 20 dropped by the satellite 12 are picked up by a following satellite 12. In this way, continuous coverage for the ground-based cells 12 is maintained. For the exemplary embodiment, the beams 32 are circular to match cells 24 near the center of the footprint 18 and elliptical to match cells 22 near the edge of the footprint 18.

FIGS. 3–6 illustrate details of an antenna system 40 for the low earth orbit satellite 12 in accordance with one embodiment of the present invention. In this embodiment, the antenna system 40 uses a planar lens system to focus signals received from the ground-based cells 20. As used herein, signal means signal received from ground-based cells 20 and any signal generated or formed based on such signals. A planar lens system is a lens system that uses one or more planar lenses.

Figure 3:
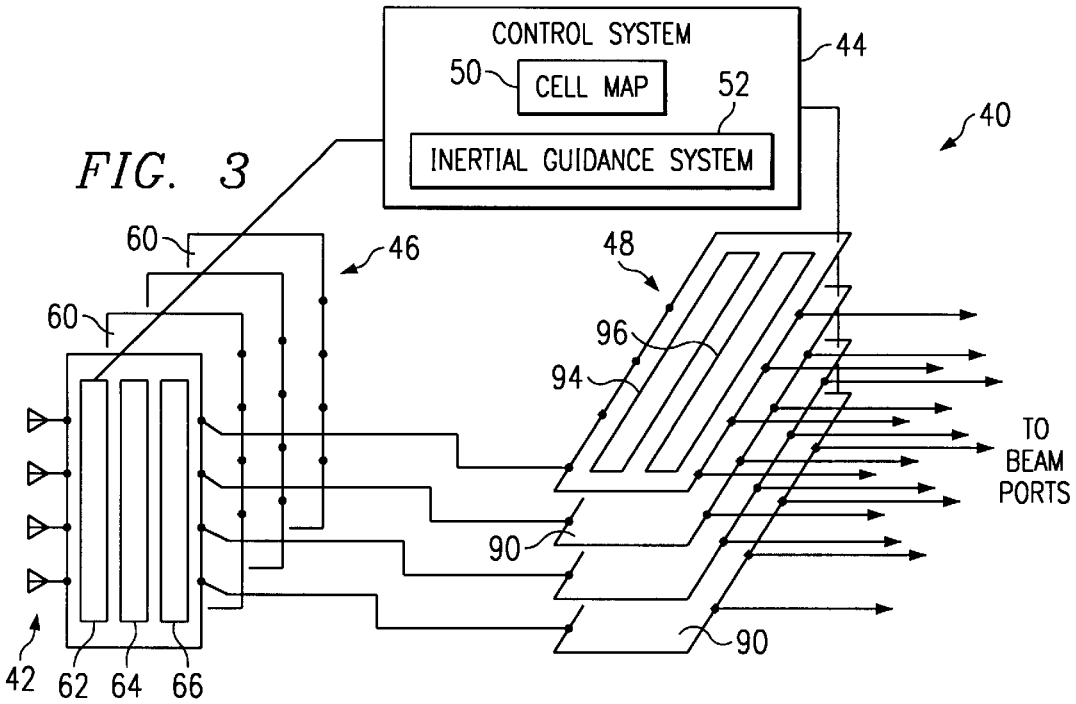
FIG. 3 is a schematic diagram illustrating a two-dimensionally steered antenna system for the satellite of FIG. 1 in accordance with one embodiment of the present invention.

Referring to FIG. 3, the antenna system 40 includes a plurality of radiating elements 42, a control system 44, a first set of array elements 46, and a second set of array elements 48. The radiating elements 42 receive component beam signals for the ground-based cells 20. As described in more detail below, the control system 44 controls steering of the component beams, which is performed by the first and second set of array elements 46 and 48.

The control system 44 includes a cell map 50 and an inertial guidance system 52. The cell map 50 stores information for each ground-based cell 20 within the orbital path of the satellite 12. The cell information includes the identification, location, and center of each cell 20. The inertial guidance system 52 tracks the position of the satellite 12 including its altitude, latitude, and longitude. The control system 44 uses the satellite positioning information along with the cell map information to calculate an angle for each beam 32 to its assigned cell 20. Based on this angle, the control system 44 determines the weight that should be given to each component beam to steer the beams 32. This information is communicated to the first and second set of array elements 46 and 48 which weigh and combine the component beams accordingly.

For the embodiment of FIGS. 3–6, the first set of array elements 46 steer the beams 32 in a first vertical direction and the second set of array elements 48 steer the beams 32 in a second horizontal direction. In this embodiment, the control system 44 provides information to the first set of array elements 46 for steering in the first direction and information to the second set of array elements 48 for steering the beams 32 in the second direction. It will be understood that the first and second directions may be otherwise oriented with respect to each other and that the control system 44 may provide other or different information to the array elements 46 and 48 to control beam 32 steering.

The first set of array elements 46 includes a plurality of discrete elements 60. Each element 60 includes an array of low noise amplifiers (LNA) 62, a first planar lens 64, and a first steering system 66. The low noise amplifiers 62 amplify the component beam signals received by the radiating elements 42.

The first planar lens 64 is a parallel plate or other suitable lens having two-dimensional characteristics. The first planar lens 64 is a Stripline Rotman lens, bi-focal pillbox lens, or other suitable two-dimensional lens. A Rotman lens is preferred because it has three focal points and thus better performance. For frequencies in the upper microwave region, the Rotman lens is constructed using microwave circuit board materials such as Duroid made by Rogers Corp. or similar materials.

Figure 4:
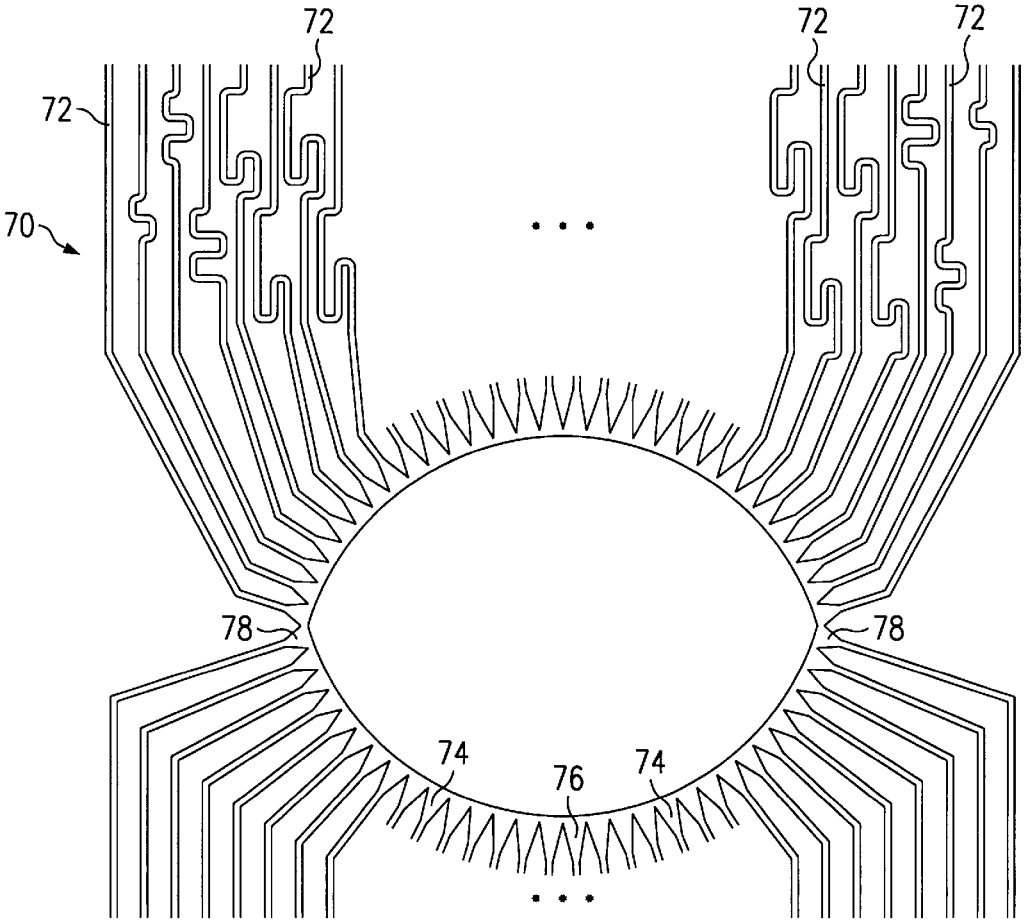
FIG. 4 is a schematic diagram illustrating a Stripline Rotman lens with non-uniform feed elements for the antenna system of FIG. 3.

FIG. 4 illustrates a Stripline Rotman lens 70 for use as the first planar lens 64 in accordance with one embodiment of the present invention. Referring to FIG. 4, the Stripline Rotman lens 70 includes a plurality of striplines 72 of varying lengths that focus the component beams in the first direction. Feed elements 74 at the bottom of the Rotman lens 70 collect the component beams that have been focused in the first direction.

In accordance with one aspect of the present invention, the feed elements 74 are non-uniform in size and spacing in order to shape the beams 32 in the first direction to match the angular size and the angular spacing of the ground-based cells 20 in the first direction. The beams 32 match the angular size of the ground-based cells 20 when they closely approximate the size of the cell as seen by the antenna system 40. In particular, feed elements 76 near the center of the Rotman lens 70 that correspond to cells 24 near the center of the footprint 18 are larger and spaced further apart than feed elements 78 at the edges of the Rotman lens 70 that correspond to cells 22 near the edge of the footprint 18 in accordance with the angular size of the cells 20. In one embodiment, the feed elements 74 are sized an spaced such that a substantially equal number of component beams are maintained for each ground-based cell 20. The particular size and spacing of the feed elements 74 may vary depending on the lens type, footprint size, cell size and shape, and other suitable criteria. By varying the size and spacing of feed elements 74, the component beams may be shaped without phase shifting. Accordingly, the complexity and cost of the antenna system 40 is reduced. In addition, the total number of component beams needed to cover the footprint 18 is reduced, which correspondingly reduces the number of feed elements 74 and other components in the beam-forming network.

Returning to FIG. 3, the first steering system 66 is operable to steer a beam 32 for a ground-based cell 20 in the first direction by weighing component beams associated with the ground-based cell 20 based on a position of the antenna system 40 relative to the ground-based cell 20 in the first direction. As previously described, this information is provided by the control system 44. The term based on the position of the antenna system 40 includes positions based on the position of any suitable element of the antenna system 40 as well as other elements of the satellite 12 or other platform offset from the antenna system 40 such that the beam steering information can be derived. Beams and other signals are associated with a ground-based cell 20 when that beam or signal is weighed, formed from, or otherwise used in forming, shaping, or steering the beam 32 for the cell 20.

Figure 5:
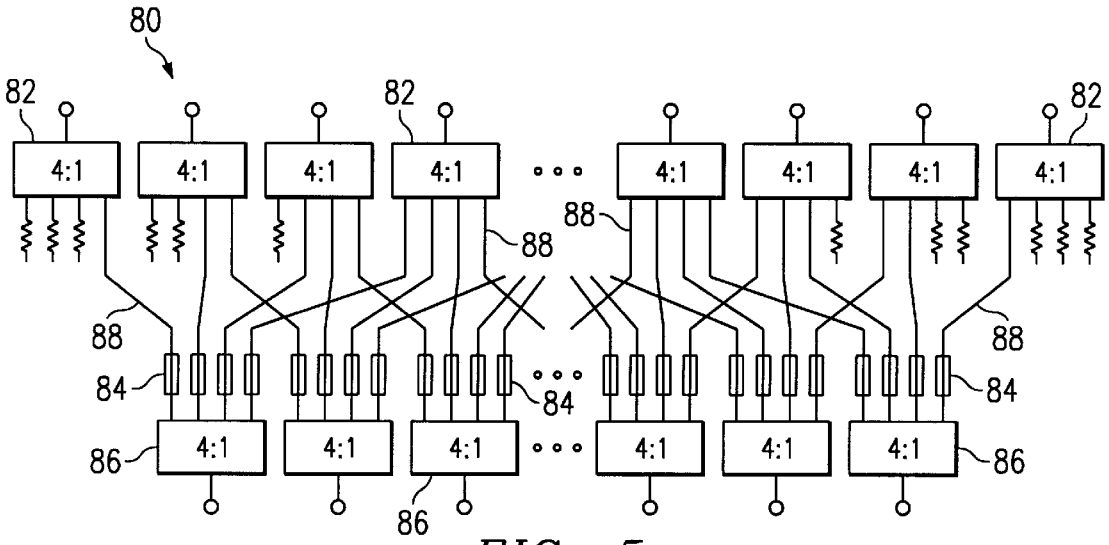
FIG. 5 is a schematic diagram illustrating details of an amplitude modulator for the antenna system of FIG. 3.

FIG. 5 illustrates details of the first steering system 66 in accordance with one embodiment of the present invention. In this embodiment, the first steering system 66 is an amplitude modulator 80. The amplitude modular 80 modulates the amplitude and combines the component beams to steer the beams 32 in the first direction.

Referring to FIG. 5, the amplitude modulator 80 includes a plurality of splitters 82, attenuators 84, and combiners 86. The splitters 82 split the component beams onto four (4) intermediate paths 88 that are each cross-connected to different combiners 86 via the attenuators 84. As used herein, the term each means each of at least a subset of the specified elements. At the edge of the amplitude modulator 80, some of the intermediate paths 88 are grounded and thus not used in accordance with the component beam combination scheme of the amplitude modulator 80. For example, in the illustrated embodiment, splitters 82 at the edge of the amplitude modulator 80 have three (3) of their intermediate paths 88 grounded, the next set of splitters 82 in from the edge have two (2) of their intermediate paths 88 grounded, the next set of splitters 82 in from the edge have one (1) intermediate path 88 grounded. The remaining splitters 82 have all of their intermediate paths 88 cross-connected with combiners 86. It will be understood that other or different suitable combination schemes may be used. For example, combination schemes of 3:1 and 5:1 may be used. In addition, variable combination schemes may be used.

The attenuators 84 modulate the amplitude of signals on the intermediate paths 88 in accordance with control information provided by the control system 44. The term attenuators includes variable gain amplifiers and other suitable devices operable to adjust the amplitude of a signal. The attenuators 84 may be implemented as digital or analog circuits. The attenuator range should match the sidelobe levels for the beams 32. Resolution and accuracy of the amplitude controls may be varied as a function of the sidelobe and beam steering accuracy requirements.

For amplitude modulation in the exemplary embodiment, component beams are indexed with $(_{p,q})$ peaks located at $U_p$, $V_p$. Beam spacing are $\Delta U_p$ and $\Delta V_q$ in the N-S (first direction) and E-W (second direction) direction respectively. For a blend of at least three (3) beams in each of the first and the second directions, the control system 44 determines amplitude weighing based on the following equations:

If $$|u-U_p| \leqq 2\Delta u_p$$

and $$|v-V_q| \leqq 2\Delta v_q$$

Then $$A_{pq} = \cos^2\left\{\frac{\pi}{4}\left(\frac{u_p - U_p}{\Delta u_p}\right)\right\}\cos^2\left\{\frac{\pi}{4}\left(\frac{v_q - V_q}{\Delta v_q}\right)\right\}$$

Else $$A_{p,q}=0$$

where:

$A_{p,q}$ is the amplitude of the $(_{p,q})$ beam; and $u_p$ and $v_q$ are coordinates of the center of the cell.

If the shaping function is constrained to be separable then for beams within $p \in [m, m+1, \ldots m+M-1]$ and $q \in [n, n+1, \ldots n+N-1]$:

$$B_{p,q}=B_p'B_q''$$

Else $$B_{p,q}=0.$$

The combined steering and shaping function will then be:

$$C_{p,q} = B_q' \frac{A_q'(u)}{A_q'(u_0)} B_q'' \frac{A_q''(v)}{A_q''(v_0)}$$

where:

$(u_0 v_o)$ is the vector to the center of a cell.

The amplitude modulated and combined component beams form intermediate beams that are focused and steered in the first direction. The intermediate beams from each element 60 of the first array of elements 46 are fed into separate elements 90 of the second set of array elements 48. Each element 90 of the second array includes a second planar lens 94 and a second steering system 96. The second planar lens 94 is a Rotman lens 70 as previously described in connection with the first planar lens 64. In this case, the Rotman lens 70 focuses and shapes the intermediate beams in the second direction.

The second steering system 96 is operable to steer the beams 32 for a ground-based cell 20 in the second direction by weighing intermediate beams associated with the ground-based cell 20 based on a position of the antenna system 40 relative to the ground-based cell 20 in the second direction. The second steering system 96 is an amplitude modulator 80 as previously described in connection with the first steering system 66. The amplitude modulator 80 modulates and combines the intermediate beams in accordance with control information provided by the control system 44. In this case, the amplitude modulator 80 steers beams 32 in the second direction. Thus, the resulting beams 32 are fully steered and shaped for each ground-based cell 20.

The amplitude modulator 80 provides smooth continuous steering for the beams 32 in both the first and second directions. The amplitude modulator 80 is operable to scan each beam 32 a full +/− one (1) beam width, or cell width, to take into account wobble of the satellite 12 and other factors and ensure that the beams 32 can maintain alignment with the ground-based cells 20 during the time the beam 32 is assigned to the cell 20. As previously described, after the satellite 12 moves one cell width, the beams 32 are each ratcheted forward one cell width in the direction of flight and the beams 32 are reassigned to the next set of cells in the flight direction. The set of cells 20 dropped by the satellite 12 are picked up by a trailing satellite 12 in the orbital plane. In this way, continuous coverage is maintained for the ground-based cells 20.

Figure 6:
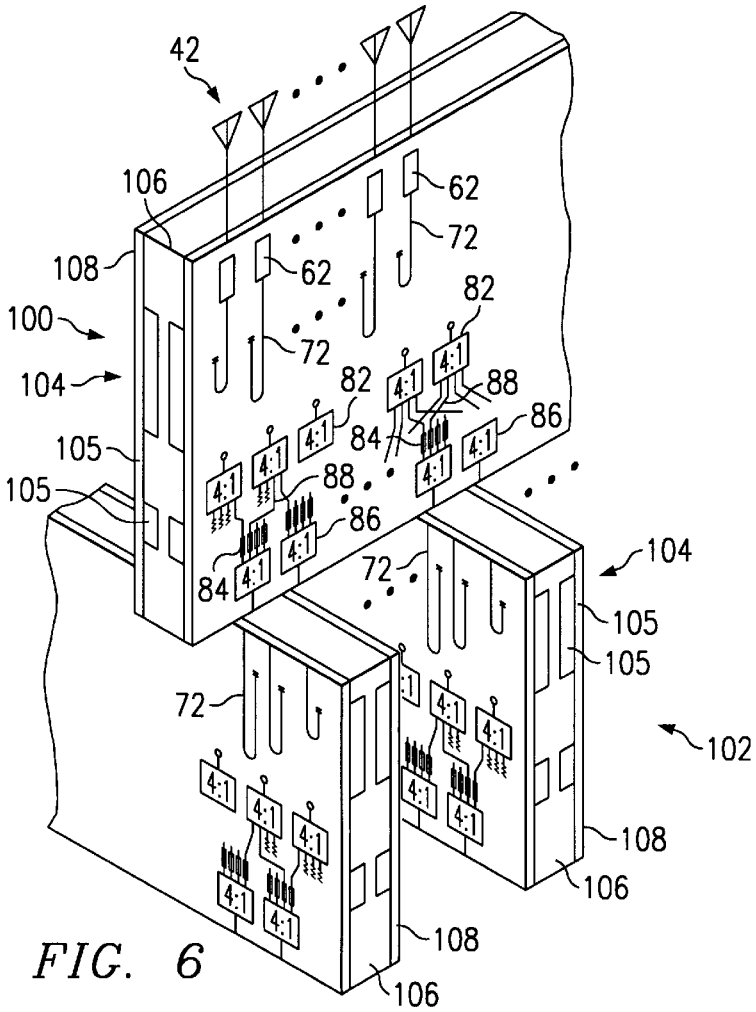
FIG. 6 is a schematic diagram illustrating packaging of the antenna system of FIG. 3.

FIG. 6 is a schematic diagram illustrating packaging of the antenna system 40 in accordance with one embodiment of the present invention. In this embodiment, the first set of array elements 46 are packaged in a first set of slats 100 and the second set of array elements 48 are packaged in a second perpendicular set of slats 102. The slats 100 and 102 each include a stripline circuit 104 formed from two circuit layers. Components of the array elements 46 and 48 are entirely fabricated within the two circuit layers 105. Preferably, the circuit layers each include a patterned conductor generally isolated between dielectric layers and shielded to minimize interference with the beam-forming network.

Referring to FIG. 6, in the stripline circuits 104, the striplines 72 for the Rotman lens 70 and the splitters 82 and combiners 86 for the amplitude modulator 80 are formed in the first circuit layer. The remainder of the Rotman lens 70 including the feed elements 74 are formed in the second circuit layer. The intermediate paths 88 are formed in both circuit layers and are cross-connected by interconnects extending between the circuit layers. The low noise amplifiers 62 are fabricated on the first circuit layer for the first set of slats 100.

The stripline circuits 104 are mounted to a cold board 106 which provides support and heat transfer for the stripline circuit 104. If the antenna system 40 is polarized to increase capacity, a corresponding set of stripline circuits 108 may be mounted to an opposite side of a cold board 106. Accordingly, the beam-forming and steering network can be located internally to a satellite or other platform with only radiating elements 42 protruding from the base. The planar slats are compact, light weight, and can be efficiently packed together. Accordingly, they are ideal for satellite and other applications that are size and weight sensitive. In addition, because the elements 60 and 90 are each fabricated entirely on only two circuit layers, the beam-forming and steering network is relatively inexpensive to fabricate.

For the exemplary embodiment, the satellite 12 includes sixty-two (62) slats 100 for the first set of array elements 46 and twenty-five (25) slats 104 for the second set of array elements 148. Slats 100 each include sixty-two (62) striplines 72 input to the Rotman lens 70 and twenty-eight (28) feed elements 74 output from the Rotman lens 70. The amplitude modulators 80 include twenty-eight (28) inputs and twenty-five (25) outputs. The slats 102 each include the Rotman lens 70 with sixty-two (62) stripline 72 inputs and thirty-two (32) feed elements 74 outputs. The amplitude modulator 80 includes thirty-two (32) inputs and twenty-nine (29) outputs for a total of seven hundred twenty-five (725) beams 32. The beams 32 are passed onto beam ports in the satellite 12 for processing.

Figure 7:
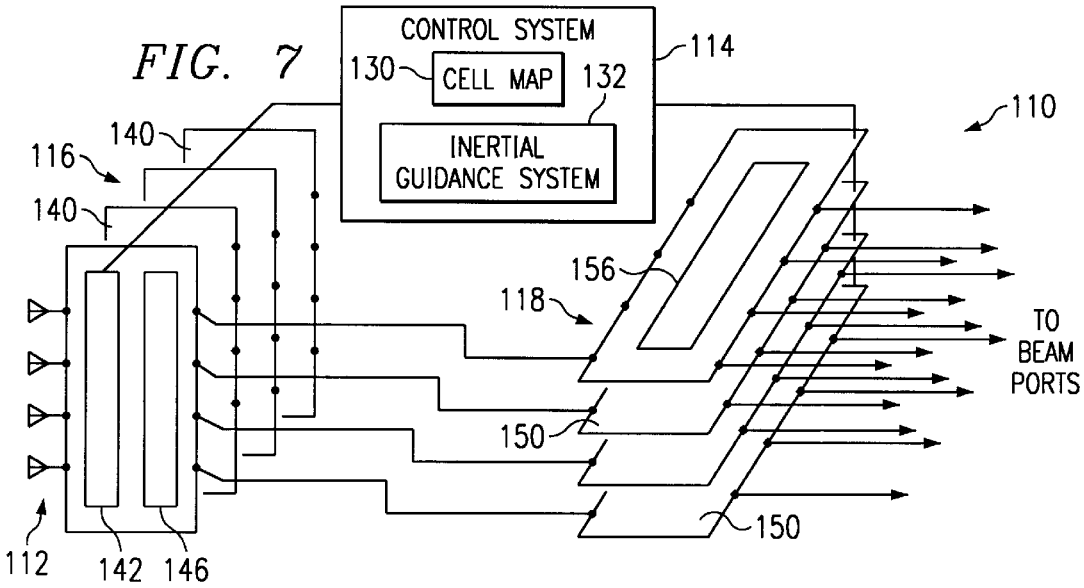
FIG. 7 is a schematic diagram illustrating a two-dimensionally steered antenna system for the satellite of FIG. 1 in accordance with another embodiment of the present invention.
Figure 8:
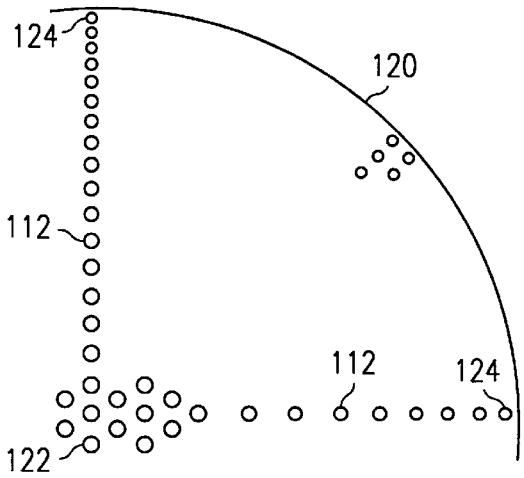
FIG. 8 is a schematic diagram illustrating a Luneberg lens with non-uniform feed elements for the antenna system of FIG. 7.
Figure 9:
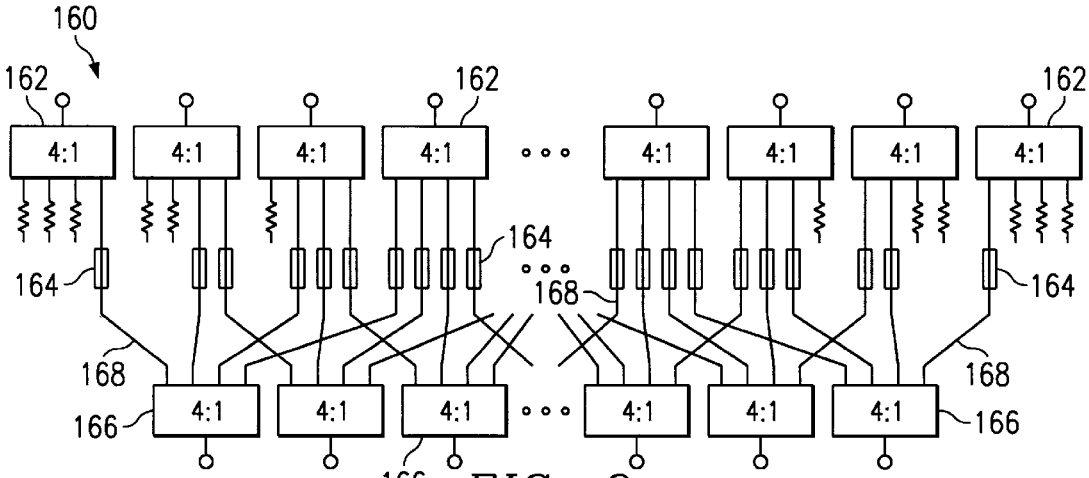
FIG. 9 is a schematic diagram illustrating details of an amplitude modulator for the antenna system of FIG. 7.

FIGS. 7–9 illustrate details of an antenna system 110 for the low earth orbit satellite 12 in accordance with another embodiment of the present invention. In this embodiment, the antenna system 110 uses a spherical dielectric lens to focus signals received from the ground-based cells 20. The spherical dielectric lens is a Luneberg or other suitable symmetrical lens. The Luneberg lens is made from concentric shells of dielectric material. The first shell has a nominal dielectric constant of 1.0, the center core has a dielectric constant of 2.0, and the intermediate shells vary uniformly between 1.0 and 2.0.

Referring to FIG. 7, the antenna system 110 includes a plurality of feed elements 112, a control system 114, a first set of array elements 116 and a second set of array elements 118. As described in more detail below, the feed elements 112 receive component beam signals for the ground-based cells 20. The control system 114 controls steering of the component beams, which is performed by the first and second array of elements 116 and 118.

Referring to FIG. 8, the feed elements 112 are mounted to a surface of a Luneberg lens 120 opposite the field of view of the lens 120 to receive component beams focused by the lens 120. In accordance with one aspect of the present invention, the feed elements 112 are non-uniform in size and spacing in order to shape the beams 32 to match the angular size of the ground-based cells. In particular, feed elements corresponding to cells 22 at the edge of the footprint 18 are smaller and spaced more closely together than feed elements 112 corresponding to cells 24 at the center of the footprint 18. In one embodiment, the feed elements 112 are sized and spaced such that a substantially equal number of component beams are maintained for each ground-based cell 20. The particular size and spacing of the feed elements 112 may vary depending on the lens type, footprint size, cell size and shape, and other suitable criteria. By varying the size and spacing of the feed elements 112, the components beams may be shaped without phase shifting. In addition, the total number of component beams needed to cover the footprint 18 is reduced by about one-half, which correspondingly reduces the number of feed elements 112 and other components in the beam-forming network.

Returning to FIG. 7, the control system 114 includes a cell map 130 and an inertial guidance system 132 as previously described in connection with the control system 44. The control system 114 uses the satellite positioning information of the interial guidance system 132 along with the cell map 130 information to calculate an angle for each beam 32 to its assigned cell 20. Based on this angle, the control system 114 determines the weight that should be given to each component beam to steer the beams 32. This information is communicated to the first and second set of array elements 116 and 118 which weigh and combine the component beams accordingly.

For the embodiment of FIGS. 7–9, the first set of array elements 116 steer the beams 32 in a first vertical direction and the second set of array elements 118 steer the beams 32 in a second horizontal direction. In this embodiment, the control system 114 provides information to the first set of array elements 116 for steering the beams 32 in the first direction and information to the second set of array elements 118 for steering the beams 32 in the second direction.

The first set of array elements 116 include a plurality of discrete elements 140. Each element 140 includes an array of low noise amplifiers (LNA) 142 and a first steering system 146. The low noise amplifiers 142 amplify the component beams as previously described in connection with the low noise amplifiers 62. The second set of array elements 118 includes a plurality of discrete elements 150 each having a second steering system 156. The components of the first and second set of array elements may be packaged into stacked slats as previously described in connection with first and second array elements 46 and 48. In this embodiment, however, the spherical lens is separate.

The first steering system 146 is operable to steer the beam 32 for a ground-based cell 20 in the first direction by weighing component beams associated with the ground-based cell 20 based on a position of the antenna system 110 relative to the ground-based cell 20 in the first direction. The second steering system 156 is operable to steer the beam 32 for a ground-based cell 20 in the second direction by weighing component beams associated with the ground-based cell 20 based on a position of the antenna system 110 relative to the ground-based cell 20 in the second direction. As previously described, control information for the steering systems 146 and 156 is provided by the control system 114.

FIG. 9 illustrates details of the first and second steering systems 146 and 156 in accordance with one embodiment of the present invention. In this embodiment, the first and second steering systems 146 and 156 are each an amplitude modulator 160. The amplitude modulator 160 modulates the amplitude of the intermediate beams and combines the modulated beams to steer the beams 32 in the first and second directions as previously described in connection with the amplitude modulator 80.

Referring to FIG. 9, the amplitude modulator 160 includes a plurality of splitters 162, attenuators 164, and combiners 166. The splitters 162 split the component beams into four (4) intermediate paths 168 that are each cross-connected to different combiners 166 via the attenuators 164. Intermediate paths 168 may be grounded for splitters 162 near the edge of the amplitude modulator 160 as previously described in connection with the amplitude modulator 80.

The attenuators 164 modulate the amplitude of the signals on the intermediate paths 168 in accordance with control information provided by the control system 114. Accordingly, as previously described in connection with the amplitude modulator 80, the amplitude modulator 160 provides smooth continuous steering for beams 32 in both the first and second directions. The amplitude modulator 160 is operable to scan each beam 32 a full +/− one (1) beam width, or cell width, to ensure that the beams 32 can maintain alignment with the ground-based cells 20 during the time the beam 32 is assigned to the cell 20.

In addition to the low earth orbit satellite 12, the present invention may be used in connection with other systems that require multiple beams to be steered. For example, the present invention can be used for geosynchronous communication satellites that use steerable spot beams, listening antennas such as ESM (Electronic Support Measures) antennas, and transmit antennas such as ECM (Electronic Counter Measures) antennas. This invention can also be used for antennas mounted on aircraft, dirigibles, or other platforms that orbit or are stationed above cites to provide communication services. If the attenuators are replaced with fixed amplitude weights, the antenna architecture may be used for applications that require a cluster of fixed beams, such as ground-based commercial wireless communications systems.

Although the present invention has been described with several embodiments, various changes and modifications may be suggested to one skilled in the art. It is intended that the present invention encompass such changes and modifications as fall within the scope of the appended claims.

What is claimed is:

1. An apparatus, comprising an antenna system which includes:

a plurality of radiating elements;

a plurality of beam ports; and a section which couples said radiating elements to said beam ports and which is operable to effect two-dimensional steering of a plurality of beams that are each associated with a respective ground-based cell, said section including first and second beam control portions which are coupled in series with each other between said radiating elements and said beam ports;

wherein said first beam control portion is operable to steer the beam for each ground-based cell in a first direction as a function of a position of said antenna system relative to the ground-based cell, said first direction being approximately normal to the beam; and wherein said second beam control portion is operable to steer the beam for each ground-based cell in a second direction as a function of the position of said antenna system relative to the ground-based cell, said second direction being different from said first direction and being approximately normal to the beam.

2. An apparatus according to claim 1, including a low earth orbit satellite, said antenna system being a part of said satellite.

3. An apparatus according to claim 1, including a plurality of low noise amplifiers which are each coupled in series between said section and a respective said radiating element.

4. An apparatus according to claim 1, wherein said first and second directions are each approximately linear, and are approximately perpendicular to each other.

5. An apparatus according to claim 1, wherein each said beam control portion includes a plurality of sub-portions, each said sub-portion including a splitter portion, a variable attenuator portion and a combiner portion which are coupled in series with each other.

6. An apparatus according to claim 5, wherein each said splitter portion includes a plurality of splitters which each split a respective signal into a plurality of component signals, wherein each said variable attenuator portion includes a plurality of variable amplitude attenuators which each effect attenuation of a respective said component signal, and wherein each said combiner portion includes a plurality of combiners which each combine a respective subset of the attenuated component signals from said attenuators.

7. An apparatus according to claim 6, wherein said variable attenuators each modulate the amplitude of a respective said component signal as a function of the position of the antenna system relative to the ground-based cell so as to weight each said component signal.

8. An apparatus according to claim 5, wherein said section includes a plurality of first slats which each have thereon a respective one said sub-portions of said first beam control portion, and includes a plurality of second slats which have thereon a respective one of said sub-portions of said second beam control portion.

9. An apparatus according to claim 8, wherein said slats each include a cold board which facilitates a transfer of heat with respect to the sub-portion disposed on the slat.

10. An apparatus according to claim 8, wherein each of said slats includes two circuit layers which implement the entirety of the sub-portion disposed on the slat.

11. An apparatus according to claim 8, wherein said section includes on each of said first slats a planar lens which is coupled in series with the sub-portion of said first beam control portion disposed on the slat, and includes on each of said second slats a planar lens which is coupled in series with the sub-portion of said second beam control portion disposed on the slat.

12. An apparatus according to claim 11, wherein said planar lenses are each a Rotman lens having non-uniform feed elements which facilitate shaping of the beam for each ground-based cell.

13. An apparatus according to claim 8, wherein said first slats are planar and parallel to each other, wherein said second slats are planar and parallel to each other, wherein said second slats extend approximately perpendicular to said first slats, wherein said first slats each have a plurality of terminals, and wherein said second slats each have a plurality of terminals which are each coupled to a respective one of said terminals on a respective one of said first slats.

14. An apparatus according to claim 8, wherein said section includes a Luneberg lens coupled in series between said radiating elements and said slats, said Luneberg lens having non-uniform feed elements which facilitate shaping of the beam for each ground-based cell.

15. An apparatus according to claim 1, wherein said section is further operable to effect shaping of the beam for each ground-based cell.

16. An apparatus according to claim 15, wherein said first and second beam control portions are each operable to facilitate the shaping of the beam for each ground-based cell.

17. An apparatus according to claim 15, wherein said section includes lens structure coupled in series with said first and second beam control portions, said lens structure being operable to facilitate the shaping of the beam for each ground-based cell.

18. An apparatus according to claim 17, wherein said first and second beam control portions are each operable to facilitate the shaping of the beam for each ground-based cell.

19. An apparatus according to claim 17, wherein said lens structure including a lens having non-uniform feed elements which facilitate the shaping of the beam for each ground-based cell.

20. An apparatus according to claim 19, wherein said non-uniform feed elements differ from each other with respect to at least one of size, shape, and inter-element spacing.

21. An apparatus according to claim 19, wherein said lens is a Luneberg lens.

22. An apparatus according to claim 21, wherein said Luneberg lens is coupled between said radiating elements and said first beam control portion.

23. An apparatus according to claim 19, wherein said lens is a Rotman lens.

24. An apparatus according to claim 17, wherein said lens structure includes first and second lens portions, said first lens portion being operable to facilitate shaping of the beams in said first direction, and second lens portion being operable to facilitate shaping of the beams in said second direction.

25. An apparatus according to claim 24, wherein said first beam control portion is coupled in series between said first and second lens portions, and wherein said second lens portion is coupled in series between said first and second beam control portions.

26. An apparatus according to claim 25, wherein said first and second lens portions each include a plurality of Rotman lenses, each said Rotman lens having non-uniform feed elements.

27. An apparatus according to claim 26, wherein said feed elements of each said Rotman lens differ from each other with respect to at least one of size, shape and inter-element spacing.

28. A method for causing an antenna system to steer a plurality of beams which correspond to respective ground-based cells, comprising the steps of:

providing first and second beam control portions which are coupled in series with each other;

determining a position of said antenna system with respect to a selected one of the ground-based cells;

causing the first beam control portion to steer the beam for the selected cell in a first direction as a function of the position of said antenna system relative to the selected cell, said first direction being approximately normal to the beam; and causing the second beam control portion to steer the beam for the selected cell in a second direction as a function of the position of said antenna system relative to the selected cell, said second direction being different from said first direction and being approximately normal to the beam.

29. A method according to claim 28, including the step of selecting said first and second directions to be approximately linear, and to be approximately perpendicular to each other.

30. A method according to claim 28, including the further step of shaping the beam for the selected ground-based cell.

31. A method according to claim 28, including the step of providing lens structure in series with the first and second beam control portions, and using the lens structure for shaping of the beam for the selected cell.

32. A method according to claim 31, wherein said lens structure includes first and second lens portions, and wherein said step of shaping the beam for the selected cell is carried out by using the first lens portion to facilitate shaping of the beam for the selected cell in the first direction, and using the second lens portion to facilitate shaping of the beam for the selected cell in the second direction.

33. An apparatus, comprising an antenna system which includes:

a plurality of radiating elements;

a plurality of beam ports; and a section which couples said radiating elements to said beam ports and which is operable to effect shaping of each of a plurality of beams associated with a respective ground-based cell, said section including first and second beam shaping portions which are coupled in series with each other between said radiating elements and said beam ports;

wherein said first beam shaping portion is operable to shape the beam for each ground-based cell in a first direction as a function of a position of said antenna system relative to the ground-based cell, said first direction being approximately normal to the beam; and wherein said second beam shaping portion is operable to shape the beam for each ground-based cell in a second direction as a function of the position of said antenna system relative to the ground-based cell, said second direction being different from said first direction and being approximately normal to the beam.

34. An apparatus according to claim 33, including a low earth orbit satellite, said antenna system being a part of said satellite.

35. An apparatus according to claim 33, wherein said first and second directions are each approximately linear, and are approximately perpendicular to each other.

36. An apparatus according to claim 33, wherein each said beam shaping portion includes a plurality of sub-portions, and wherein said section includes a plurality of first slats which each have thereon a respective one of said sub-portions of said first beam shaping portion, and a plurality of second slats which each have thereon a respective one of said sub-portions of said second beam shaping portion.

37. An apparatus according to claim 36, wherein each of said slats includes two circuit layers which implement the entirety of the sub-portion disposed on the slat.

38. An apparatus according to claim 36, wherein said sub-portions each include a planar lens, and a plurality of non-uniform feed elements for the planar lens.

39. An apparatus according to claim 38, wherein said non-uniform feed elements differ from each other with respect to at least one of size, shape and inter-element spacing.

40. An apparatus according to claim 38, wherein each said planar lens is a Rotman lens.

41. A method for causing an antenna system to shape a plurality of beams which correspond to respective ground-based cells, comprising the steps of:

providing first and second beam shaping portions which are coupled in series with each other;

determining a position of the antenna system with respect to a selected one of the ground-based cells;

causing the first beam shaping portion to shape the beam for the selected cell in a first direction as a function of the position of the antenna system relative to the selected cell, the first direction being approximately normal to the beam; and causing the second beam shaping portion to shape the beam for the selected cell in a second direction as a function of the position of the antenna system relative to the selected cell, the second direction being different from the first direction and being approximately normal to the beam.

42. A method according to claim 41, including the step of selecting the first and second directions to be approximately linear, and to be approximately perpendicular to each other.

* * * * *